US007779543B2

(12) United States Patent
Wang et al.

(10) Patent No.: US 7,779,543 B2
(45) Date of Patent: Aug. 24, 2010

(54) RAZOR WITH MOVEABLE CENTER OF BALANCE

(75) Inventors: Jennifer Wang, New Haven, CT (US); Sylvie Biragnet, Stamford, CT (US); Evelyn Takesue, Easton, CT (US)

(73) Assignee: Eveready Battery Company, Inc.

( * ) Notice: Subject to any disclaimer, the term of this patent is extended or adjusted under 35 U.S.C. 154(b) by 338 days.

(21) Appl. No.: 11/540,446

(22) Filed: Sep. 28, 2006

(65) Prior Publication Data

US 2008/0078086 A1 Apr. 3, 2008

(51) Int. Cl.
*B26B 21/40* (2006.01)

(52) U.S. Cl. ..... 30/50; 30/526; 16/430; 16/436

(58) Field of Classification Search ..... 30/32, 30/34.05, 50, 526, 537; 81/22; 16/430, 436
See application file for complete search history.

(56) References Cited

U.S. PATENT DOCUMENTS

| | | | | | |
|---|---|---|---|---|---|
| 2,189,689 | A | | 2/1940 | Thompson | |
| 2,235,841 | A | * | 3/1941 | Monnet | 30/526 |
| 2,264,323 | A | | 12/1941 | Monnet | |
| 2,320,374 | A | * | 6/1943 | Monnet | 30/74.1 |
| 2,387,765 | A | * | 10/1945 | Monnet | 30/34.05 |
| 3,172,438 | A | * | 3/1965 | Gianelli | 81/22 |
| 3,435,521 | A | * | 4/1969 | Kuhnl | 30/60.5 |
| 3,918,155 | A | * | 11/1975 | Atkins | 30/47 |
| 4,332,321 | A | | 6/1982 | Wratschko | |
| 4,385,665 | A | * | 5/1983 | Knoll | 173/162.1 |
| 4,389,777 | A | * | 6/1983 | Landsberger | 30/324 |
| 5,002,136 | A | * | 3/1991 | Barthomeuf | 173/114 |
| 5,031,319 | A | | 7/1991 | Althaus et al. | |
| 5,669,143 | A | * | 9/1997 | Wu | 30/324 |
| 6,026,578 | A | | 2/2000 | Brenner | |
| 7,219,433 | B2 | * | 5/2007 | Gorenflo et al. | 30/383 |
| 7,246,414 | B2 | * | 7/2007 | Wu | 16/430 |
| 2003/0070309 | A1 | * | 4/2003 | Brown et al. | 30/535 |
| 2004/0181953 | A1 | | 9/2004 | Follo et al. | |
| 2009/0158600 | A1 | * | 6/2009 | Ishai | 30/314 |

FOREIGN PATENT DOCUMENTS

| | | | |
|---|---|---|---|
| EP | 0 987 088 | * | 3/2000 |
| WO | WO2004/076136 | | 10/2004 |

OTHER PUBLICATIONS

International Search Report for PCT/US2007/020770, dated Feb. 18, 2008.
International Preliminary Report on Patentability issued Apr. 9, 2009 regarding international application No. PCT/US2007/020770.

* cited by examiner

*Primary Examiner*—Hwei-Siu C Payer
(74) *Attorney, Agent, or Firm*—Energizer Personal Care, LLC

(57) ABSTRACT

A handle for a safety razor has an elongated cavity within the handle and a body disposed within the elongated cavity and moveable along the cavity under the influence of gravity between two positions. In a first position the razor has a first center of balance. In the second position the razor has a second center of balance different from the first center of balance. The handle has a damping fluid within the cavity or a resilient member to damp the movement of the body.

6 Claims, 3 Drawing Sheets

RAZOR WITH MOVEABLE CENTER OF BALANCE

BACKGROUND

1. Technical Field

This invention relates generally to razors, and more specifically to a wet shaving razor having a moveable center of balance.

2. Background Information

Many modern shaving implements, also commonly known as wet shave or safety razors, include a disposable razor cartridge releasably connected to a reusable handle. Other modern safety razors have a handle and a razor cartridge that are intended to be permanently coupled and disposed of as a single unit. The handles of both reusable and disposable razors are generally intended to be gripped by a user in a manner of the user's choosing to suit the specific body area being shaved. The user may find it desirous to grip the handle in the vicinity of the razor cartridge when shaving sensitive or curved areas. Conversely, the user may find it desirous to grip the handle in the vicinity of the end opposite the razor cartridge when shaving broader or flatter areas. U.S. Pat. No. 5,031,319 to Althaus et al describes the desirability of providing the center of gravity, or center of balance, of the razor in the vicinity of where the thumb, index and middle fingers rest so that the razor is balanced in use. Many known razors have a generally fixed center of balance, thus if the user chooses to grip the handle away from the center of balance the razor will be less balanced in use. U.S. Pat. No. 2,189,689 to Thompson and U.S. Pat. No. 2,264,323 to Monnet attempt to address this problem by providing a razor handle with adjustable weights that may be moved by the user to provide a center of balance preferred by the user. However, adjustment of the Thompson or Monnet razors is somewhat complicated, requires a specific action by the user and is not automatic.

Based on the foregoing, it is desirous to provide a razor handle having a center of balance that can be automatically varied in use depending on the user's chosen grip or the attitude of the razor.

SUMMARY

Embodiments of the safety razor of the present invention comprise a handle and a razor cartridge. The handle has a gripping portion and a head portion. The head portion is adapted for selectively mounting the razor cartridge to the head portion. The gripping portion has an elongated cavity. A body, at least partially solid, is disposed within the cavity and is able to move along the elongated cavity under the influence of gravity between a first position and a second position. The cavity is provided with damping means so that the movement of the solid body is controlled and the safety razor does not exhibit jerkiness in use. When the body is in the first position the safety razor has a first center of balance and when the body is in the second position the safety razor has a second center of balance different from the first center of balance. The body can be a single part or a plurality of discrete parts. The damping means can be a damping fluid disposed in the reservoir and selected such that movement of the body through the fluid damps the movement of the body. The damping means can alternatively be a resilient member disposed at one or both ends of the elongated cavity such that deceleration of the body at the end or ends of its motion along the cavity is controlled.

Embodiments of the invention can include one or more of the following advantages. When the gripping portion of the handle is gripped at an end adjacent the head portion and the head portion is at a lower elevation than the gripping portion, the center of balance of the safety razor will be in the vicinity of where the thumb and fingers rest so the razor has improved balanced in use. When the gripping portion of the handle is gripped at an end opposite the head portion and the head portion is at a higher elevation than the gripping portion, the center of balance of the safety razor will be in the vicinity of where the thumb and fingers now rest so the razor again has improved balance in use. The above features and advantages of the present invention will be more fully understood with reference to the following detailed description when taken in conjunction with the accompanying drawings.

DETAILED DESCRIPTION

Figure 1:
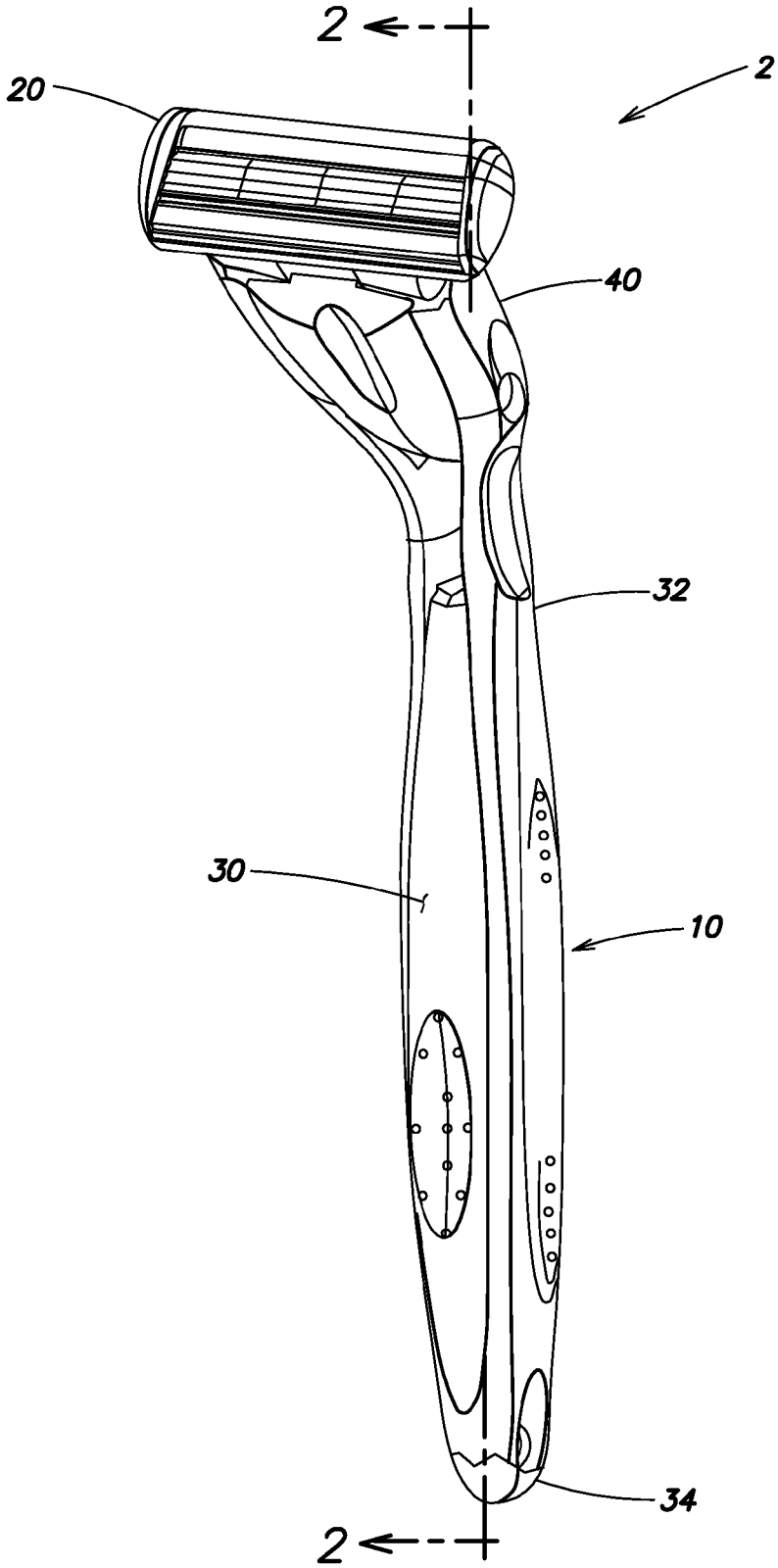
FIG. 1 is an isometric view of an embodiment of a safety razor of the present invention.
Figure 2A:
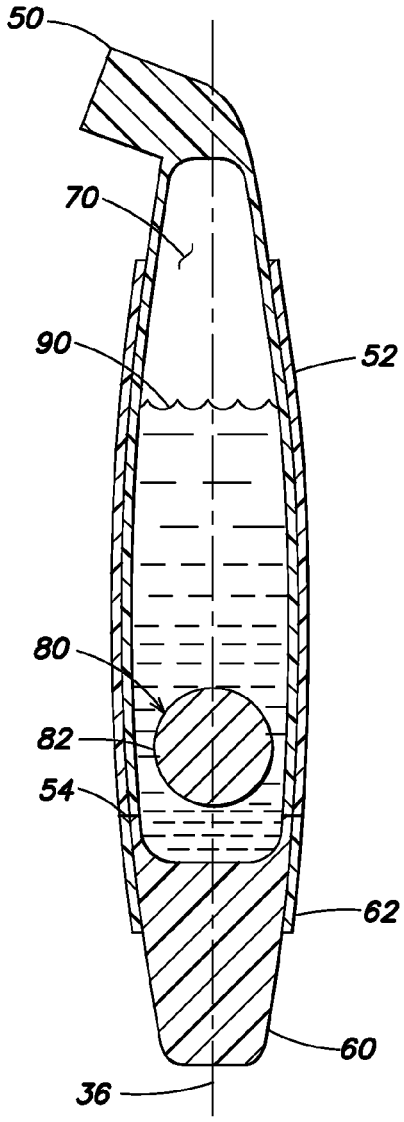
FIG. 2A is a sectional view of the handle of FIG. 1 taken along line 2-2 in a 'head up' attitude
Figure 2B:
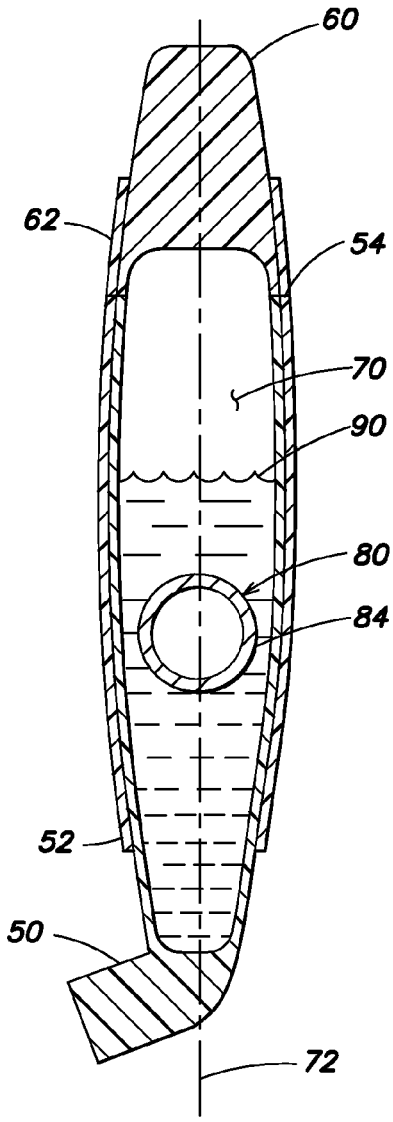
FIG. 2B is a sectional view of the handle of FIG. 1 taken along line 2-2 in a 'head down' attitude

Referring to the drawings and in particular FIG. 1, a safety razor 2 comprises a handle 10 and a razor cartridge 20. The razor cartridge can comprise a housing and one or more razor blades disposed within the housing and the present invention is not limited in regard to the construction of the razor cartridge. The handle 10 comprises a gripping portion 30 and a head portion 40. The gripping portion has a head end 32 adjacent the head portion and an opposed tail end 34. The head portion is adapted for selectively mounting the razor cartridge 20 and the present invention is not limited in this regard. One of skill in the art will understand that many well known cartridge mounting arrangements can be employed, for example a shell bearing arrangement or a journal bearing arrangement etc. Referring additionally now to FIGS. 2A and 2B, for benefits of ease of assembly as will be described later, the gripping portion 30 of the handle, preferably comprises two rigid thermoplastic component parts 50, 60 permanently or securely joined together. Preferably, as will further be described later, in one embodiment the joint 54 between the two components is in a plane generally perpendicular to locus 36 along the gripping portion. Preferably the thermoplastic material is a polypropylene or ABS, although other thermoplastics or metals or a combination thereof may be selected and the present invention is not limited in this regard. Most preferably one or both rigid parts are provided with an outer layer of an elastomeric thermoplastic (TPE) 52, 62 respectively as is well known in the art. The TPE layer imparts at least enhanced comfort in the user's hand and enhanced gripping characteristics for the user when gripping the handle in a wet environment. The polypropylene material is selected at least for its ability to readily provide a secure bond to a wide range of TPE materials, for its ability to readily be ultrasonically welded to provide one permanent joining method between the two handle parts 50, 60 and for its chemical resistance to a damping fluid, as will be described later. Other well known permanent or secure joining methods such as use of an adhesive, alternate welding processes, use of a press-fit or snap-fit may also be employed and the present invention is not limited in this regard. If a secure but non-permanent joint is provided between parts 50 and 60 this should be engineered such that these parts are substantially inseparable by a user. One of skill in the art will understand that a gripping portion comprising a single component part or more than two parts may also be employed in the present invention is not limited in this regard.

The gripping portion 30 of the handle 10 is provided with an elongated cavity 70 that extends generally along the locus 36 of the gripping portion. In one embodiment the cavity is preferably generally barrel shaped although other shapes may conveniently be employed and the present invention is not limited in this regard. In this instance a barrel shape refers to a three dimensional form having a generally enlarged waist portion. The cavity can also have rounded end portions. One of skill in the art will understand that the gripping portion of the handle can be substantially straight or curved or comprise straight and curved portions. Thus, locus 36 can be straight or curved or combinations thereof.

A body 80 is disposed within the elongated cavity prior to the joining operation between handle parts 50 and 60. In one embodiment of the present invention, a damping fluid 90 is further disposed in the cavity prior to the joining operation. The benefit of the perpendicular joint 54 will now be understood as this enables part 50 to have the body 80 and damping fluid 90 inserted before part 60 is joined to part 50. For simplicity the damping fluid can be air although one of skill in the art will recognize that this requires a closer attention to manufacturing tolerances of the relevant component parts than use of a liquid damping fluid having a higher viscosity than that of air. Preferably the damping fluid is oil and the benefit of selecting polypropylene for the two rigid handle parts 50, 60 for its chemical resistance to hydrocarbon materials will now be recognized. Most preferably the oil is a vegetable oil having a viscosity less than about 100 cP. The damping fluid can also be water-based and the present invention is not limited in this regard. The body 80 is preferably spherical and most preferably manufactured from stainless steel having a diameter about 6 mm. Other materials and forms such as a cylinder or a capsule can also be employed. The present invention is not limited in this regard as other combinations of body shape, size and material and damping fluid viscosity can usefully be employed. The body has a bulk specific gravity substantially different (ie greater or smaller) than the specific gravity of the damping fluid. The body 80 may be substantially solid 82 or comprise a thin shell 84 having a hollow core. When the razor is gripped by a user in an attitude where the longitudinal locus 72 of the elongated cavity is other than horizontal, the body will either reside at the top or bottom of the elongated cavity as a result of the differential specific gravities of the body and damping fluid. In either event, the element having the greater specific gravity, be it body 80 or fluid 90, will reside at a lower elevation in the elongated cavity and the resulting center of balance will be biased towards that end of the safety razor having a lower elevation. Thus, if the razor is held in a generally 'head up' attitude, as for example can occur while the user is shaving her axillae, the center of balance of the razor will be biased toward the tail end 34 of the gripping portion and will provide a more balanced use of the razor when the gripping portion is held between the user's thumb and fingers generally at the tail end. This is generally depicted in FIG. 2A. Conversely, when the razor is held in a generally 'head down' attitude, as for example can occur when the user is shaving a more sensitive area such as her bikini area, the center of balance of the razor will be biased toward the head end of the gripping portion and will provide a more balanced use of the razor when the gripping portion is held between the user's thumb and fingers generally at the head end. This is generally depicted in FIG. 2B. In FIGS. 2A and 2B the body 80 is depicted slightly spaced away from its lower at-rest position for clarity.

The benefit of the elongated cavity 70 having a barrel shape will now be described in more detail. As the body 80 passes along the cavity under the influence of gravity as a result of the user changing the orientation of the razor, movement of the body displaces the damping fluid from the front of the body (relative to its direction of movement) to the back of the body. As the body passes along the barrel shaped cavity the clearance between the body and the inner walls of the cavity varies and the clearance is greatest adjacent the enlarged waist of the barrel. In this position, the damping fluid provides less resistance and the body is able to pass through the fluid at a greater velocity than at other positions along the cavity. As the body moves away from the waist portion of the barrel and approaches an end of the cavity the clearance between the body and the inner wall of the cavity decreases. The resistive effect of the damping fluid increases and the velocity of the body is attenuated. Preferably, close to the end of its range of motion along the cavity, the clearance between the body and the cavity is at its smallest. The damping fluid has its greatest effect and reduces the velocity of the body to substantially zero. In this way, undesirable jerkiness that might lead to nicks and cuts, as might occur if the body was abruptly brought to rest, is avoided.

Figure 3:
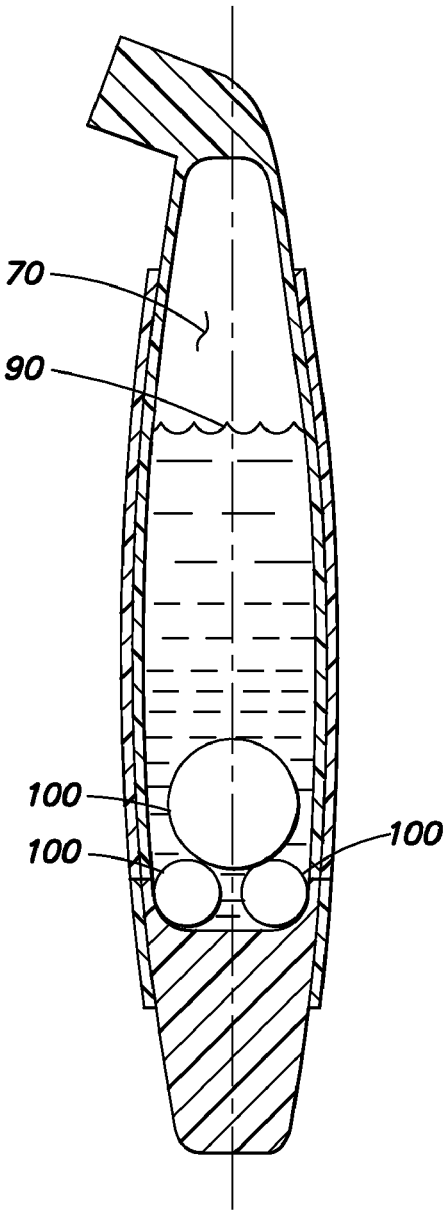
FIG. 3 is a sectional view of another embodiment of a handle of the present invention taken along line 2-2

Referring now to FIG. 3, another embodiment of the handle of the present invention is depicted. In this embodiment of the present invention the body 100 comprises several parts. The body can comprise a great many minute parts such that the combination of the body in the damping fluid is a slurry. The body can also comprise several larger parts or a combination of one or more parts and a slurry.

Figure 4:
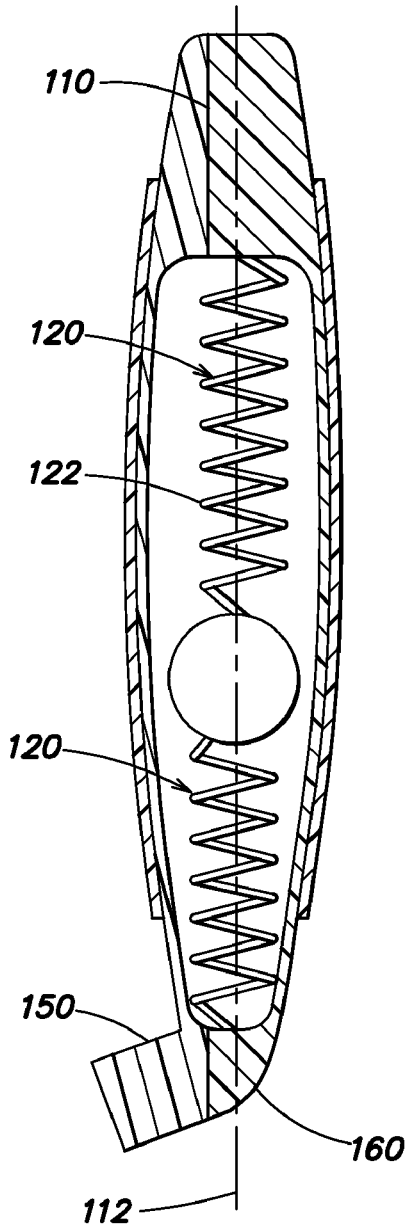
FIG. 4 is a sectional view of further embodiment of a handle of the present invention taken along line 2-2.

Referring now to FIG. 4, a further embodiment of the handle of the present invention is depicted. In this embodiment, the damping fluid is fully or partially omitted and a damping effect of the motion of the body as it moves along the elongated cavity is provided by a resilient element 120 extending between the body and the end portion of the cavity. The resilient element can be at one or both ends of the elongated cavity. The resilient element can be a discrete part, for example a separate compression spring 122 or a highly deformable elastomeric pad or a pad of foam material. The compression spring can have a constant spring rate but is preferably designed so that the spring rate is variable and provides minimum velocity of the body, preferably approaching zero for reasons as previously described, as the body approaches an end of its range of motion along the cavity. The resilient element can also be integrally formed with the body or integrally formed with one handle part 150 or 160. In this embodiment, the joint between the two handle parts 110 is preferably substantially parallel to locus 112 along the gripping portion for at least the benefit of ease of assembly.

It is to be understood that the present invention is by no means limited to the particular construction herein disclosed and/or shown in the drawings, but also comprises any modifications or equivalents within the scope of the disclosure.

What is claimed is:

1. A safety razor, comprising:

a razor cartridge, and a handle, the handle having an elongated cavity therein, a solid body disposed within the cavity and moveable therealong under the influence of gravity between a first position and a second position spaced apart from the first position, and means to damp the movement of the body, wherein the damping means comprises a liquid disposed within the elongated cavity, wherein in the first position the safety razor defines a first center of balance and in the second position the safety razor defines a second center of balance, wherein the first center of balance and the second center of balance are different;

wherein movement of the body from the first position to the second position defines a velocity; and wherein the velocity of the body is attenuated to substantially zero when the body is close to the second position.

2. The safety razor of claim 1, wherein the body comprises a unitary part.

3. The safety razor of claim 1, wherein the body comprises a plurality of parts.

4. The safety razor of claim 1, wherein said elongated cavity is barrel shaped.

5. A handle for a safety razor, comprising:

a hand gripping portion and a head portion adapted for selective mounting of a razor cartridge thereon, the gripping portion having an elongated cavity therein, a solid body disposed within the cavity and moveable therealong under the influence of gravity between a first position and a second position spaced apart from the first position, and means to damp the movement of the body, wherein the damping means comprises a liquid disposed within the elongated cavity, wherein in the first position, the handle defines a first center of balance and in the second position the handle defines a second center of balance, and wherein the first center of balance and the second center of balance are different;

wherein movement of the body from the first position to the second position defines a velocity; and wherein the velocity of the body is attenuated to substantially zero when the body is close to the second position.

6. The razor handle of claim 5, wherein said elongated cavity is barrel shaped.

* * * * *